US010352601B2

(12) United States Patent
Morimoto et al.

(10) Patent No.: US 10,352,601 B2
(45) Date of Patent: Jul. 16, 2019

(54) REFRIGERANT EVAPORATOR

(71) Applicant: DENSO CORPORATION, Kariya, Aichi-pref. (JP)

(72) Inventors: Masakazu Morimoto, Kariya (JP); Eiichi Torigoe, Kariya (JP); Naohisa Ishizaka, Kariya (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 149 days.

(21) Appl. No.: 15/547,302

(22) PCT Filed: Feb. 25, 2016

(86) PCT No.: PCT/JP2016/001022
§ 371 (c)(1),
(2) Date: Jul. 28, 2017

(87) PCT Pub. No.: WO2016/136265
PCT Pub. Date: Sep. 1, 2016

(65) Prior Publication Data

US 2018/0023872 A1 Jan. 25, 2018

(30) Foreign Application Priority Data

Feb. 27, 2015 (JP) ..... 2015-038170
Aug. 7, 2015 (JP) ..... 2015-156956

(51) Int. Cl.
*F28D 1/04* (2006.01)
*F25B 47/00* (2006.01)
(Continued)

(52) U.S. Cl.
CPC ..... *F25B 47/006* (2013.01); *F25B 39/00* (2013.01); *F25B 39/02* (2013.01); *F28D 1/0452* (2013.01);
(Continued)

(58) Field of Classification Search
CPC ..... F25B 47/006; F25B 39/00; F25B 39/02; F28F 9/0243; F28F 9/268; F28F 9/028;
(Continued)

(56) References Cited

U.S. PATENT DOCUMENTS 5,713,217 A 2/1998 Baba
2004/0206490 A1* 10/2004 Katoh ..... F25B 39/02 165/174
(Continued)

FOREIGN PATENT DOCUMENTS

DE 102010031406 A1 1/2012
JP S62034964 U 3/1987
(Continued)

*Primary Examiner* — Ana M Vazquez
(74) *Attorney, Agent, or Firm* — Harness, Dickey & Pierce, P.L.C.

(57) ABSTRACT

A refrigerant evaporator includes: a first heat exchange part in which refrigerant flows to exchange heat with fluid to be cooled; a second heat exchange part arranged to oppose the first heat exchange part; a first tank arranged below the first heat exchange part to distribute the refrigerant to the first heat exchange part; a second tank arranged below the second heat exchange part to collect the refrigerant flowing through the second heat exchange part; and a third tank joined to the first tank and the second tank by brazing. A projection part is formed at one of joint portions between the first tank and the third tank. An insertion part is formed at the other of the joint portions between the first tank and the third tank, and the projection part is inserted in the insertion part.

7 Claims, 14 Drawing Sheets

(51) Int. Cl.

| | |
|---|---|
| ***F25B 39/02*** | (2006.01) |
| ***F28F 9/02*** | (2006.01) |
| ***F28F 9/26*** | (2006.01) |
| ***F28D 1/053*** | (2006.01) |
| ***F25B 39/00*** | (2006.01) |
| *F28D 21/00* | (2006.01) |

(52) U.S. Cl.
CPC ..... *F28D 1/05391* (2013.01); *F28F 9/0204* (2013.01); *F28F 9/028* (2013.01); *F28F 9/0243* (2013.01); *F28F 9/268* (2013.01); *F25B 2500/06* (2013.01); *F28D 2021/0064* (2013.01); *F28F 9/0209* (2013.01)

(58) Field of Classification Search
CPC ..... F28F 9/0204; F28F 9/0209; F28D 1/0452; F28D 1/05391; F28D 2021/0064
See application file for complete search history.

(56) References Cited

U.S. PATENT DOCUMENTS

2007/0074861 A1* 4/2007 Higashiyama ..... F28D 1/05391 165/174
2009/0282850 A1 11/2009 Higashiyama
2013/0312455 A1* 11/2013 Jeon ..... F28D 1/0435 62/525
2015/0027163 A1 1/2015 Ishizaka et al.
2016/0084548 A1 3/2016 Ota et al.
2016/0097597 A1 4/2016 Ishizaka
2016/0109168 A1 4/2016 Baba
2017/0328615 A1 11/2017 Morimoto et al.

FOREIGN PATENT DOCUMENTS

JP S63034491 A 2/1988
JP H07041282 U 7/1995
JP H8110125 A 4/1996
JP 200150686 A 2/2001
JP 2003214794 A 7/2003
JP 2006194576 A 7/2006
JP 2010197019 A 9/2010
JP 2013185723 A 9/2013
JP 2014219174 A 11/2014
JP 2014219176 A 11/2014
JP 2014228155 A 12/2014
JP 2014228234 A 12/2014

* cited by examiner

REFRIGERANT EVAPORATOR

CROSS REFERENCE TO RELATED APPLICATIONS

This application is a U.S. National Phase Application under 35 U.S.C. 371 of International Application No. PCT/JP2016/001022 filed on Feb. 25, 2016 and published in Japanese as WO 2016/136265 A1 on Sep. 1, 2016. This application is based on and claims the benefit of priority from Japanese Patent Application No. 2015-038170 filed on Feb. 27, 2015 and Japanese Patent Application No. 2015-156956 filed on Aug. 7, 2015 and is based on Japanese Patent Application No. 2016-032054 filed on Feb. 23, 2016. The entire disclosures of all of the above applications are incorporated herein by reference.

TECHNICAL FIELD

The present disclosure relates to a refrigerant evaporator in which heat is exchanged between a fluid to be cooled and a refrigerant.

BACKGROUND ART

Patent Literature 1 describes a refrigerant evaporator. The refrigerant evaporator described in Patent Literature 1 includes a first heat exchange part and a second heat exchange part in which heat is exchanged with air that is a fluid to be cooled. The first heat exchange part and the second heat exchange part are arranged to oppose in a flowing direction of air. The first heat exchange part is divided into a first core part and a second core part in a direction perpendicular to the flowing direction of air. The second heat exchange part is also divided into a first core part and a second core part in a direction perpendicular to the flowing direction of air. The first core part of the first heat exchange part opposes the first core part of the second heat exchange part in the flowing direction of air. The second core part of the first heat exchange part opposes the second core part of the second heat exchange part in the flowing direction of air. The refrigerant evaporator described in Patent Literature 1 includes a pair of tanks disposed at the respective ends of the first heat exchange part in the vertical direction, and a pair of tanks disposed at the respective ends of the second heat exchange part in the vertical direction. Moreover, the refrigerant evaporator described in Patent Literature 1 includes a switch tank between the tank disposed below the first heat exchange part in the vertical direction and the tank disposed below the second heat exchange part in the vertical direction.

In the refrigerant evaporator described in Patent Literature 1, refrigerant flows from the tank above the second heat exchange part in the vertical direction to the first core part and the second core part of the second heat exchange part. The refrigerant flowing into the first core part of the second heat exchange part flows from the tank below the second heat exchange part in the vertical direction through the switch tank and the tank below the first heat exchange part in the vertical direction into the second core part of the first heat exchange part. The refrigerant flowing into the second core part of the second heat exchange part flows from the tank below the second heat exchange part in the vertical direction through the switch tank and the tank below the first heat exchange part in the vertical direction into the first core part of the first heat exchange part. The refrigerant flowing into the first core part of the first heat exchange part, and the refrigerant flowing into the second core part of the first heat exchange part are discharged through the tank above the first heat exchange part in the vertical direction.

PRIOR ART LITERATURES

Patent Literature

Patent Literature 1: JP 2013-185723 A

SUMMARY OF INVENTION

In the refrigerant evaporator described in Patent Literature 1, the switch tank may be fixed to the tank below the first heat exchange part in the vertical direction and the tank below the second heat exchange part in the vertical direction, for example, by surface brazing. In detail, the switch tank is brazed by heat-treating under a predetermined temperature in a state where a connection surface of the switch tank is made in surface contact with a connection surface of the tank below the first heat exchange part in the vertical direction and a connection surface of the tank below the second heat exchange part in the vertical direction. In case where the connection surface of the switch tank is made in surface contact with the connection surface of the tank below the first heat exchange part in the vertical direction, it is difficult to make the whole surfaces in surface contact with each other, and a portion where the surface contact is not achieved may partially occur between the connection surfaces. In this case, a gap is formed in the portion where the surface contact is not achieved. This causes so-called sink marks which mean minute clearance formed between the connection surface of the switch tank and the connection surface of the tank below the first heat exchange part in the vertical direction. Similarly, sink marks may be formed by the brazing between the connection surface of the switch tank and the connection surface of the tank below the second heat exchange part in the vertical direction.

In case where water is condensed on an external surface of the first heat exchange part and the second heat exchange part based on the heat exchange between refrigerant and air, the condensed water flows downward in the vertical direction. If a gap is generated due to sink marks between the connection surface of the switch tank and the connection surface of the tank below the first heat exchange part in the vertical direction, the condensed water may stay in the gap. Similarly, if a gap is generated due to sink marks between the connection surface of the switch tank and the connection surface of the tank below the second heat exchange part in the vertical direction, the condensed water may stay in the gap. If the stored water is frozen, the volume of the water is increased, and the tanks may be damaged, what is called as a freezing crack.

It is an object of the present disclosure to provide a refrigerant evaporator in which a crack caused by freezing is restricted.

According to an aspect of the present disclosure, a refrigerant evaporator in which heat is exchanged between a fluid to be cooled and a refrigerant includes: a first heat exchange part in which the refrigerant flows to exchange heat between the fluid to be cooled and the refrigerant; a second heat exchange part in which the refrigerant flows to exchange heat between the fluid to be cooled and the refrigerant, the second heat exchange part being arranged to oppose the first heat exchange part; a first tank arranged below the first heat exchange part to distribute the refrigerant to the first heat exchange part; a second tank arranged below the second heat exchange part to collect the refrigerant flowing through the second heat exchange part; and a third tank joined to the first tank and the second tank by brazing and to introduce the refrigerant collected by the second tank to the first tank. A projection part is formed at one of respective joint portions of the first tank and the third tank. An insertion part is formed at the other of the respective joint portions of the first tank and the third tank, and the projection part is inserted in the insertion part.

Accordingly, when the brazing is performed between the joint portion of the first tank and the joint portion of the third tank, a starting point of the brazing can be secured by a contact portion between the projection part and the insertion part. The sink marks can be prevented from being generated, since a surface brazing between the first tank and the third tank is avoidable. As a result, since a gap storing condensed water is hardly formed at the joining section between the first tank and the third tank, a freezing crack can be restricted from being generated.

Alternatively, a projection part may be formed at one of respective joint portions of the second tank and the third tank, and an insertion part may be formed at the other of the respective joint portions of the second tank and the third tank. The projection part is inserted in the insertion part.

Accordingly, a freezing crack can be restricted from being generated, since a gap storing condensed water is hardly formed at the joining section between the second tank and the third tank.

DESCRIPTION OF EMBODIMENTS

First Embodiment

Figure 1:
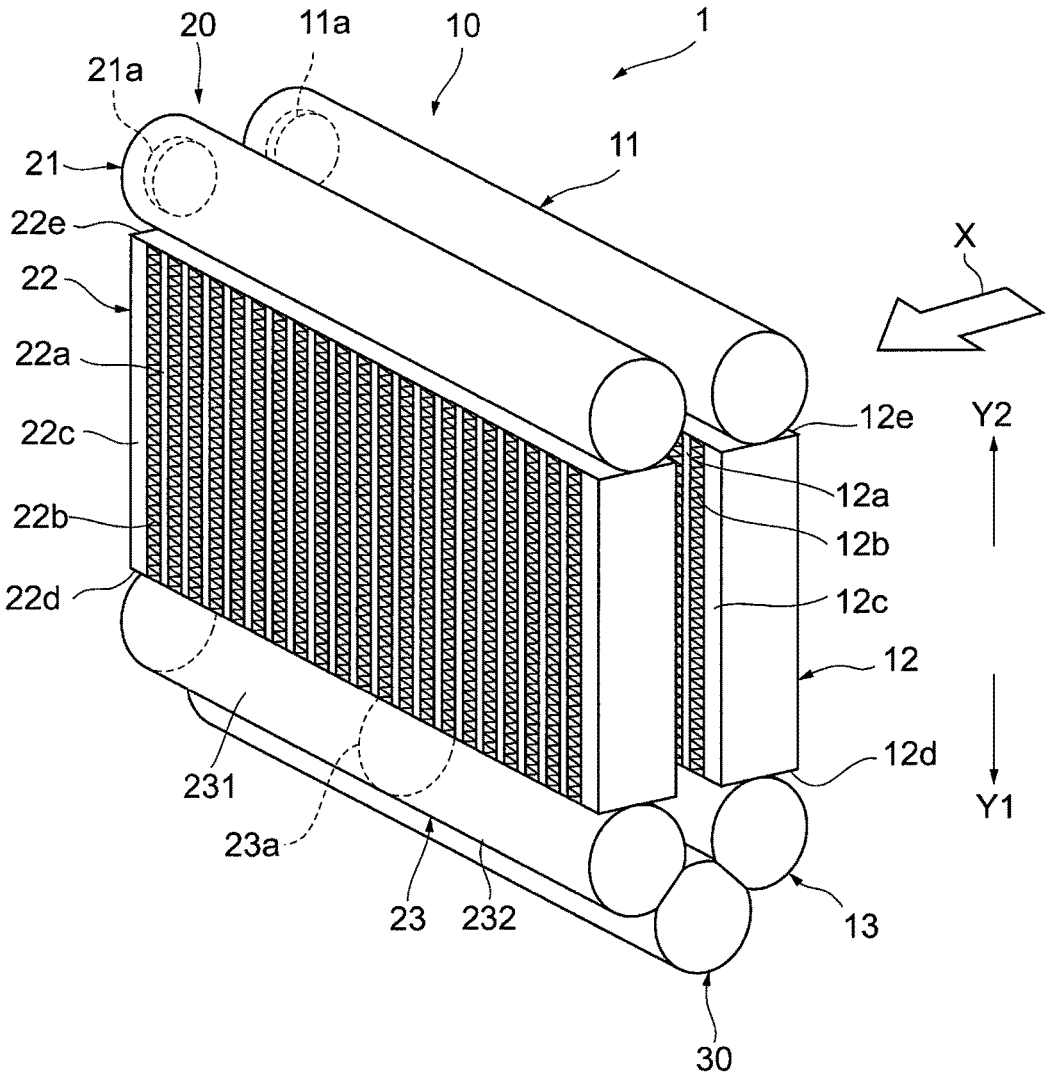
FIG. 1 is a perspective view illustrating a refrigerant evaporator according to a first embodiment.

Hereafter, a refrigerant evaporator of a first embodiment is described. The refrigerant evaporator 1 of this embodiment shown in FIG. 1 is used for a refrigeration cycle for an air-conditioner for a vehicle, which conditions air in the cabin. Specifically, the refrigerant evaporator 1 is a cooling heat exchanger for cooling air by absorbing heat from air to be sent to the cabin to evaporate the liquid phase refrigerant. The refrigeration cycle includes a compressor, a radiator, an expansion valve, which are not illustrated but well known, in addition to the refrigerant evaporator 1.

Figure 2:
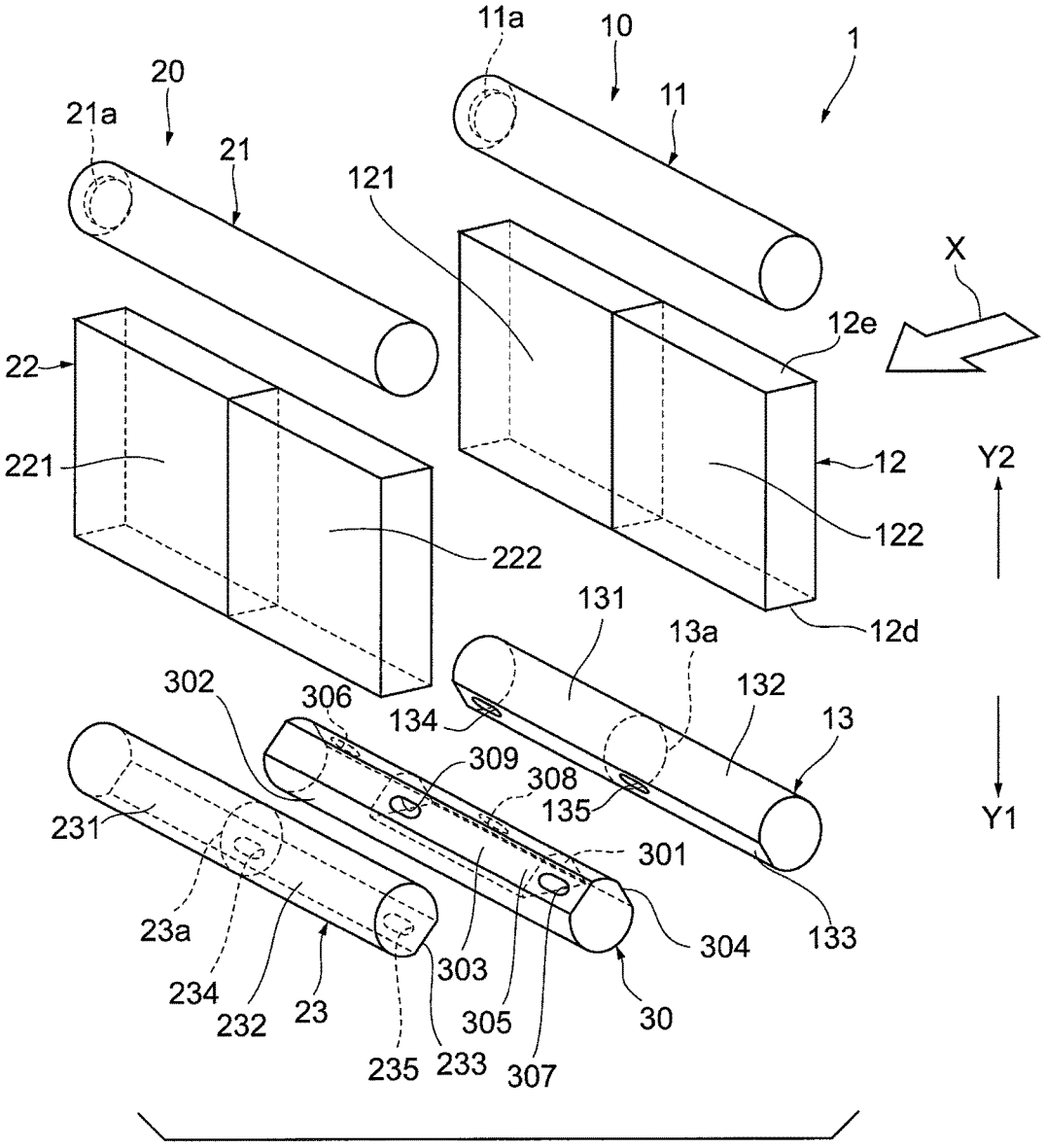
FIG. 2 is an exploded perspective view illustrating the refrigerant evaporator of the first embodiment.

As shown in FIG. 1 and FIG. 2, the refrigerant evaporator 1 includes two evaporation parts 10 and 20 and a switch tank 30. The evaporation part 10 is arranged on the upstream side and the evaporation part 20 is arranged on the downstream side in an air flowing direction X. In this embodiment, the air flowing direction X is a direction perpendicular to a vertical direction Y1, Y2. Hereafter, the evaporation part 10 arranged upstream in the air flowing direction X is called as "the windward side evaporation part 10." Moreover, the evaporation part 20 arranged downstream in the air flowing direction X is called as "the leeward side evaporation part 20."

The windward side evaporation part 10 has a windward side collection tank 11, a windward side heat exchange part 12, and a windward side distribution tank 13. The windward side collection tank 11, the windward side heat exchange part 12, and the windward side distribution tank 13 are arranged in this order downward in the vertical direction Y1.

The windward side heat exchange part 12 has a rectangular parallelepiped shape. The windward side heat exchange part 12 is arranged so that the air flowing direction X corresponds to the thickness direction. The windward side distribution tank 13 is attached to a lower-side end surface 12*d* of the windward side heat exchange part 12 in the vertical direction Y1. The windward side collection tank 11 is attached to an upper-side end surface 12*e* of the windward side heat exchange part 12 in the vertical direction Y2. The windward side heat exchange part 12 includes plural tubes 12*a* and plural fins 12*b* alternately stacked with each other in the horizontal direction. In FIG. 2, illustration of the tube 12*a* and the fin 12*b* is omitted. The tube 12*a* is arranged to extend in the vertical direction Y1, Y2, and has a flat shape in the cross-section. A passage for flowing refrigerant is formed in the tube 12*a*. The fin 12*b* is what is called a corrugated fin formed by bending a thin metal plate. The fin 12*b* is arranged between the tubes 12*a* adjacent to each other in the horizontal direction, and is joined to the external surface of the tube 12*a*. As shown in FIG. 2, the windward side heat exchange part 12 is divided into a first windward side core part 121 and a second windward side core part 122 in the stacking direction of the tube 12*a* and the fin 12*b*. Moreover, as shown in FIG. 1, the windward side heat exchange part 12 has a side plate 12*c* on the both ends in the stacking direction of the tube 12*a* and the fin 12*b*. The side plate 12*c* is a component for reinforcing the windward side heat exchange part 12.

The windward side distribution tank 13 is a cylindrical component in which a passage for refrigerant is defined. The both ends of the windward side distribution tank 13 in the axial direction are closed. As shown in FIG. 2, the windward side distribution tank 13 has a partition board 13*a* at the central part in the axial direction. The partition board 13*a* divides the internal passage of the windward side distribution tank 13 into a first distribution part 131 and a second distribution part 132. Plural through holes, which are not illustrated, are defined in the external surface of the windward side distribution tank 13, and the lower end of the tube 12*a* in the vertical direction Y1 is inserted into the through hole. The internal passage of the first distribution part 131 is communicated to the tube 12*a* of the first windward side core part 121 by the through hole, and the internal passage of the second distribution part 132 is communicated to the tube 12*a* of the second windward side core part 122 by the through hole. That is, the first distribution part 131 distributes refrigerant to the tubes 12*a* of the first windward side core part 121. Moreover, the second distribution part 132 distributes refrigerant to the tubes 12*a* of the second windward side core part 122.

Figure 3:
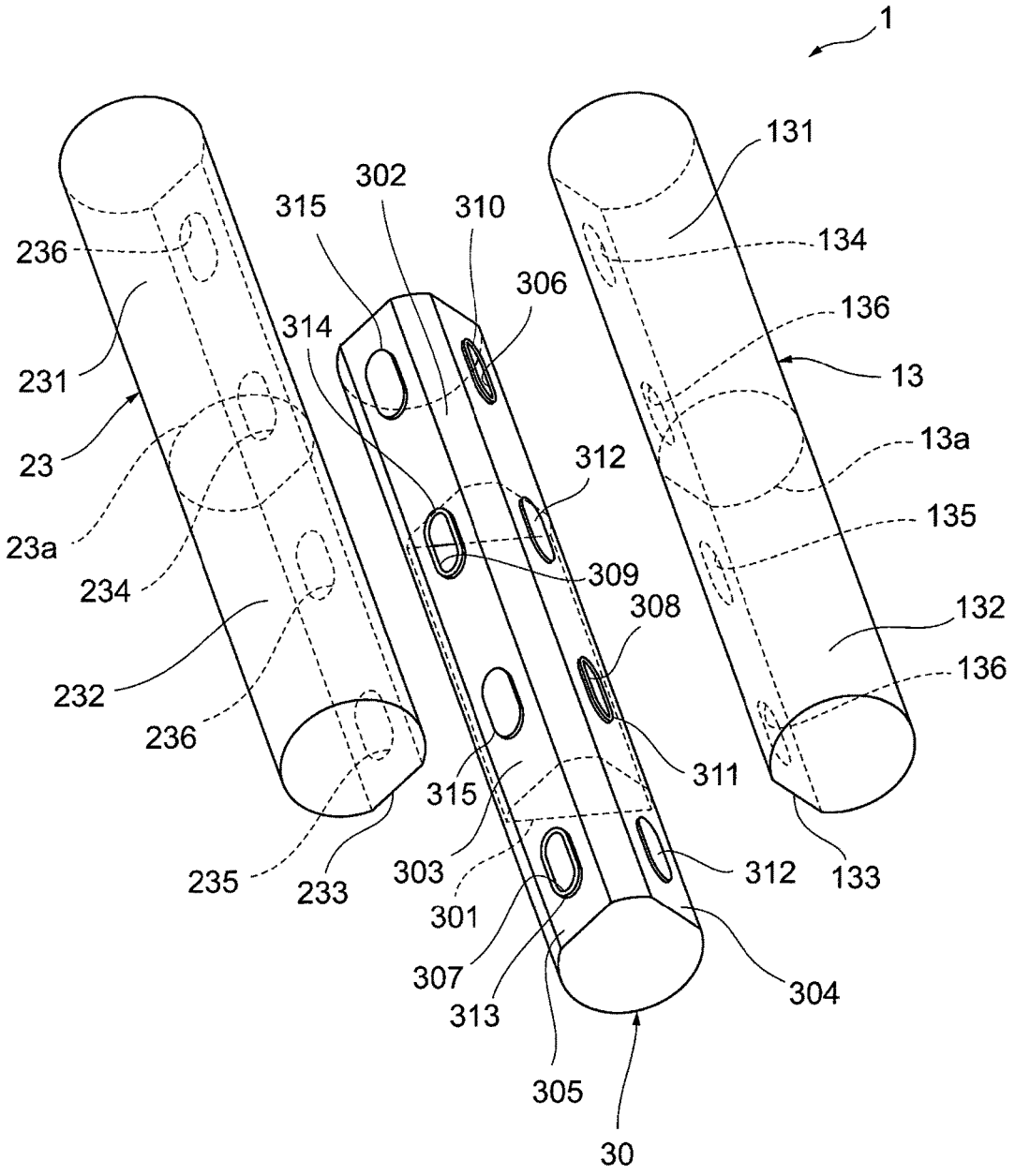
FIG. 3 is an exploded perspective view illustrating a windward distribution tank, a leeward collection tank, and a switch tank of the refrigerant evaporator of the first embodiment.
Figure 4:
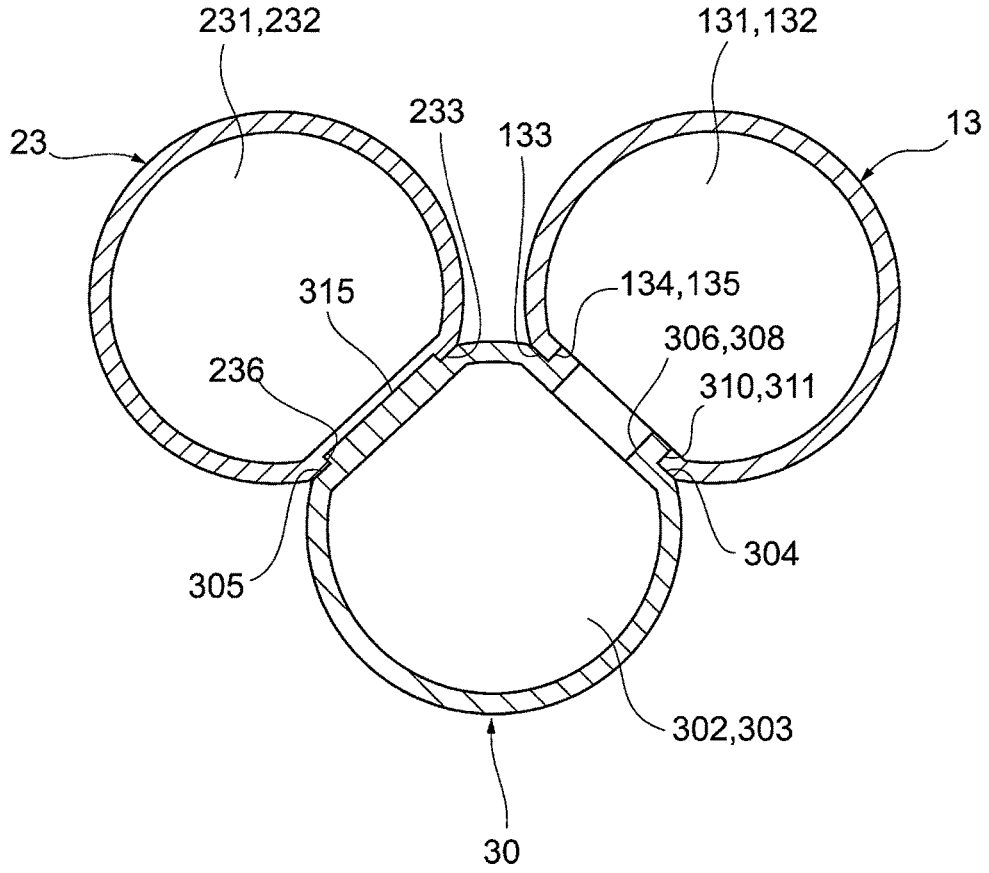
FIG. 4 is a sectional view illustrating the windward distribution tank, the leeward collection tank, and the switch tank of the refrigerant evaporator of the first embodiment.
Figure 5:
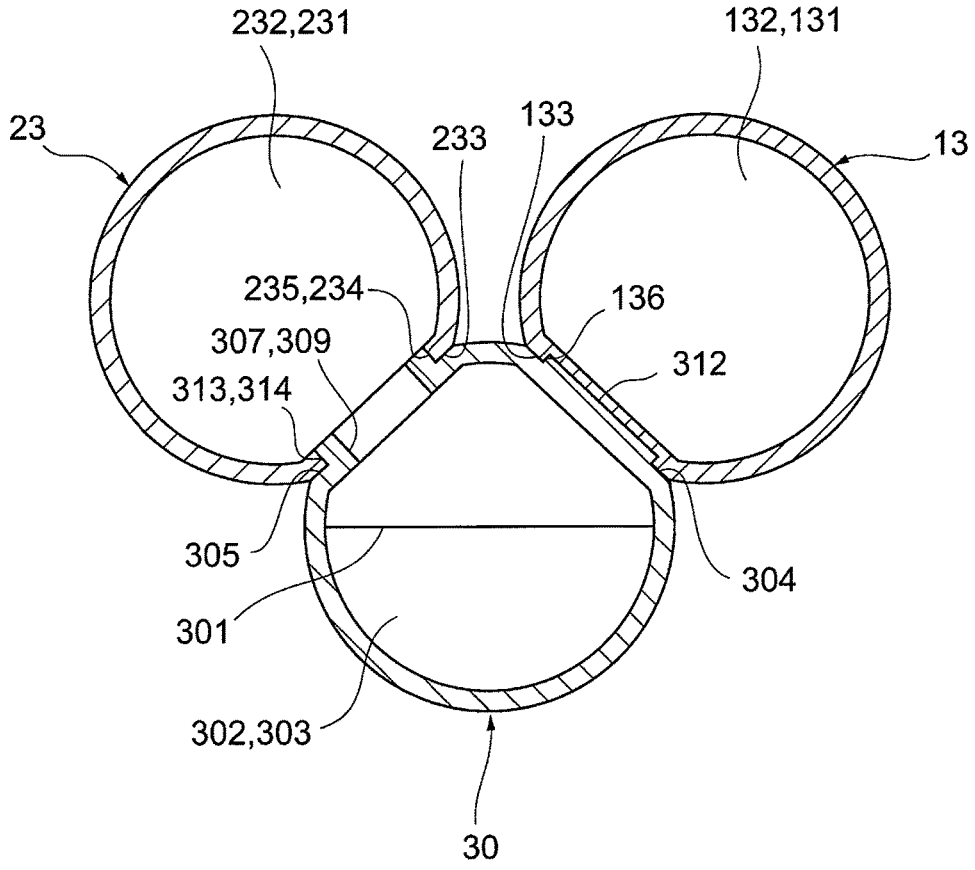
FIG. 5 is a sectional view illustrating the windward distribution tank, the leeward collection tank, and the switch tank of the refrigerant evaporator of the first embodiment.

As shown in FIG. 3, a joint portion 133 having a plane shape is formed on the external surface of the windward side distribution tank 13 to extend in the axial direction. The joint portion 133 is a portion to which the switch tank 30 is joined. The joint portion 133 has a through hole 134, 135. As shown in FIG. 4, the through hole 134 passes through to the internal passage of the first distribution part 131 from the external surface of the joint portion 133. The through hole 134 is a passage for leading the refrigerant from the switch tank 30 to the first distribution part 131. The through hole 135 passes through to the internal passage of the second distribution part 132 from the external surface of the joint portion 133. The through hole 135 is a passage for leading the refrigerant from the switch tank 30 to the second distribution part 132. As shown in FIG. 3, a portion of the windward side distribution tank 13 where the through hole 134, 135 is not defined has plural recess parts 136. As shown in FIG. 5, the recess part 136 has a groove shape not passing through to the internal passage of the windward side distribution tank 13. In FIG. 2, the illustration of the recess part 136 is omitted.

As shown in FIG. 1 and FIG. 2, the windward side collection tank 11 is a cylindrical component in which a passage is defined for refrigerant. One end part of the windward side collection tank 11 in the axial direction is closed. The other end part of the windward side collection tank 11 in the axial direction defines a refrigerant outlet 11*a*. The refrigerant outlet 11*a* is connected to the intake side of the non-illustrated compressor. Moreover, non-illustrated plural through holes are formed in the external surface of the windward side collection tank 11, and the upper end of the tube 12*a* in the vertical direction Y2 is inserted into the through hole. The internal passage of the windward side collection tank 11 is communicated to the tube 12*a* of the first windward side core part 121 and the tube 12*a* of the second windward side core part 122 by the respective through holes. That is, the refrigerant which flows through the tube 12*a* of the first windward side core part 121, and the refrigerant which flows through the tube 12*a* of the second windward side core part 122 are brought together into the windward side collection tank 11. The refrigerant collected in the windward side collection tank 11 is introduced into the compressor through the refrigerant outlet 11*a*.

The leeward side evaporation part 20 has a leeward side distribution tank 21, a leeward side heat exchange part 22, and a leeward side collection tank 23. The leeward side distribution tank 21, the leeward side heat exchange part 22, and the leeward side collection tank 23 are arranged in this order downward in the vertical direction Y1.

The leeward side heat exchange part 22 has the structure approximately the same as the windward side heat exchange part 12. That is, the leeward side heat exchange part 22 has a rectangular parallelepiped shape, and is arranged so that the air flowing direction X corresponds to the thickness direction. The leeward side heat exchange part 22 includes plural tubes 22*a* and plural fins 22*b* alternately stacked with each other in the horizontal direction, and has a side plate 22*c* on the both ends in the stacking direction of the tube 22*a* and the fin 22*b*. The leeward side collection tank 23 is attached to a lower end surface 22*d* of the leeward side heat exchange part 22 in the vertical direction Y1. The leeward side distribution tank 21 is attached to an upper end surface 22*e* of the leeward side heat exchange part 22 in the vertical direction Y2. Moreover, as shown in FIG. 2, the leeward side heat exchange part 22 is divided into a first leeward side core part 221 opposing the first windward side core part 121 and a second leeward side core part 222 opposing the second windward side core part 122 in the air flowing direction X.

The leeward side distribution tank 21 is a cylindrical component which has a passage for refrigerant inside. One end part of the leeward side distribution tank 21 in the axial direction is closed. The other end part of the leeward side distribution tank 21 in the axial direction defines a refrigerant inlet 21*a*. Low-pressure refrigerant decompressed by the non-illustrated expansion valve flows into the refrigerant inlet 21*a*. Moreover, non-illustrated plural through holes are formed in the external surface of the leeward side distribution tank 21, and the upper end of the tube 22*a* in the vertical direction Y2 is inserted into the through hole. The internal passage of the leeward side distribution tank 21 is communicated to the tube 22*a* of the first leeward side core part 221 and the tube 22*a* of the second leeward side core part 222 by the through hole. That is, the refrigerant which flowed into the leeward side distribution tank 21 from the refrigerant inlet 21*a* is distributed to the tube 22*a* of the first leeward side core part 221 and the tube 22*a* of the second leeward side core part 222.

The leeward side collection tank 23 is a cylindrical component which has a passage for refrigerant inside. The both ends of the leeward side collection tank 23 in the axial direction are closed. The leeward side collection tank 23 has a partition board 23*a* at the central part in the axial direction. As shown in FIG. 2, the partition board 23*a* divides the internal passage of the leeward side collection tank 23 into a first collection part 231 and a second collection part 232. Moreover, non-illustrated plural through holes are formed in the external surface of the leeward side collection tank 23, and the lower end of the tube 22*a* in the vertical direction Y1 is inserted into the through hole. Due to the through hole, the internal passage of the first collection part 231 is communicated to the tube 22*a* of the first leeward side core part 221, and the internal passage of the second collection part 232 is communicated to the tube 22*a* of the second leeward side core part 222. That is, the refrigerant which flows through the tubes 22*a* of the first leeward side core part 221 is brought together in the first collection part 231. Moreover, the refrigerant which flows through the tubes 22*a* of the second leeward side core part 222 is brought together in the second collection part 232.

As shown in FIG. 3, the external surface of the leeward side collection tank 23 defines a joint portion 233 having a plane shape to extend in the axial direction. The joint portion 233 is a portion to which the switch tank 30 is joined. The joint portion 233 has a through hole 234, 235. As shown in FIG. 5, the through hole 235 passes through to the internal passage of the second collection part 232 from the external surface of the joint portion 233. The through hole 235 is a passage for introducing the refrigerant from the second collection part 232 to the switch tank 30. The through hole 234 passes through to the internal passage of the first collection part 231 from the external surface of the joint portion 233. The through hole 234 is a passage for introducing the refrigerant from the first collection part 231 to the switch tank 30. Moreover, as shown in FIG. 3, a portion of the leeward side distribution tank 23 where the through hole 234, 235 is not defined has plural recess parts 236. As shown in FIG. 4, the recess part 236 has a groove shape not passing through to the internal passage of the leeward side collection tank 23. In FIG. 2, the illustration of the recess part 236 is omitted.

In this embodiment, the leeward side collection tank 23 corresponds to a first tank, and the windward side heat exchange part 12 corresponds to a second tank. Moreover, the leeward side heat exchange part 22 corresponds to a first heat exchange part, and the windward side heat exchange part 12 corresponds to a second heat exchange part. Further, the through hole 134, 135 and the recess part 136 of the windward side distribution tank 13 and the through hole 234, 235 and the recess part 236 of the leeward side collection tank 23 correspond to an insertion part.

The switch tank 30 is arranged between the windward side distribution tank 13 and the leeward side collection tank 23. In this embodiment, the switch tank 30 corresponds to a third tank. The switch tank 30 is a cylindrical component which has a passage for refrigerant inside. A partition component 301 is disposed inside the switch tank 30. The partition component 301 divides the interior space of the switch tank 30 to a first refrigerant passage 302 and a second refrigerant passage 303.

As shown in FIG. 3, the external surface of the switch tank 30 defines a joint portion 304 having a plane shape to which the joint portion 133 of the windward side distribution tank 13 is joined, and a joint portion 305 having a plane shape to which the joint portion 233 of the leeward side collection tank 23 is joined.

The join portion 304 has a projection part 310 inserted to the through hole 134 of the windward side distribution tank 13, a projection part 311 inserted to the through hole 135 of the windward side distribution tank 13, and a projection part 312 inserted to the recess part 136 of the windward side distribution tank 13. In FIG. 2, the illustration of the projection part 310-312 is omitted.

A through hole 306 is defined in the projection part 310. As shown in FIG. 4, the through hole 306 passes through to the first refrigerant passage 302 from the tip end surface of the projection part 310. The external surface of the projection part 310 is fixed to the inner circumference surface of the through hole 134 of the windward side distribution tank 13 by brazing. As shown in FIG. 3, a through hole 308 is defined in the projection part 311. As shown in FIG. 4, the through hole 308 passes through to the second refrigerant passage 303 from the tip end surface of the projection part 311. The external surface of the projection part 311 is fixed to the internal surface of the through hole 135 of the windward side distribution tank 13 by brazing. The through hole 306, 308 of the projection part 310, 311 and the through hole 134, 135 of the windward side distribution tank 13 define a passage for the refrigerant. As shown in FIG. 5, the external surface of the projection part 312 is fixed to the internal surface of the recess part 136 of the windward side distribution tank 13 by brazing. A refrigerant passage is not defined in the projection part 312 and the recess part 136. That is, the projection part 312 and the recess part 136 are defined at a portion of the switch tank 30 and the windward side distribution tank 13 different from a portion where the refrigerant passage is formed.

As shown in FIG. 3, the joint portion 305 has a projection part 313 inserted in the through hole 235 of the leeward side collection tank 23, a projection part 314 inserted in the through hole 234 of the leeward side collection tank 23, and a projection part 315 inserted in the recess part 236 of the leeward side collection tank 23. In FIG. 2, illustration of the projection parts 313-315 is omitted.

A through hole 307 is defined in the projection part 313. As shown in FIG. 5, the through hole 307 passes through to the first refrigerant passage 302 from the tip end surface of the projection part 313. The external surface of the projection part 313 is fixed to the inner circumference surface of the through hole 235 of the leeward side collection tank 23 by brazing. As shown in FIG. 3, a through hole 309 is defined in the projection part 314. As shown in FIG. 5, the through hole 309 passes through to the second refrigerant passage 303 from the tip end surface of the projection part 314. The external surface of the projection part 314 is fixed to the inner circumference surface of the through hole 234 of the leeward side collection tank 23 by brazing. The through hole 307, 309 of the projection part 313, 314 and the through hole 234, 235 of the leeward side collection tank 23 define a passage for the refrigerant. As shown in FIG. 4, the external surface of the projection part 315 is fixed to the internal surface of the recess part 236 of the leeward side collection tank 23 by brazing. A refrigerant passage is not formed in the projection part 315 and the recess part 236. That is, the projection part 315 and the recess part 236 are defined at a portion of the switch tank 30 and the leeward side collection tank 23 other than a portion where the refrigerant passage is formed.

In the switch tank 30, the refrigerant collected in the first collection part 231 of the leeward side collection tank 23 flows into the second refrigerant passage 303 through the through hole 234 of the leeward side collection tank 23 and the through hole 309 of the switch tank 30. The refrigerant which flowed into the second refrigerant passage 303 is led to the second distribution part 132 of the windward side distribution tank 13 through the through hole 308 of the switch tank 30 and the through hole 135 of the windward side distribution tank 13.

Meanwhile, the refrigerant collected in the second collection part 232 of the leeward side collection tank 23 flows into the first refrigerant passage 302 through the through hole 235 of the leeward side collection tank 23 and the through hole 307 of the switch tank 30. The refrigerant which flowed into the first refrigerant passage 302 is led to the first distribution part 131 of the windward side distribution tank 13 through the through hole 306 of the switch tank 30 and the through hole 134 of the windward side distribution tank 13.

Thus, the switch tank 30 functions as a portion which introduces the refrigerant collected in the leeward side collection tank 23 to the windward side distribution tank 13. Moreover, the switch tank 30 functions as a portion which exchanges the flows of refrigerant in the leeward side heat exchange part 22 and the flows of refrigerant in the windward side heat exchange part 12 with each other in the stacking direction of the tubes 12*a*, 22*a*.

Next, the flow of refrigerant in the refrigerant evaporator 1 and a method of cooling air are explained.

Figure 6:
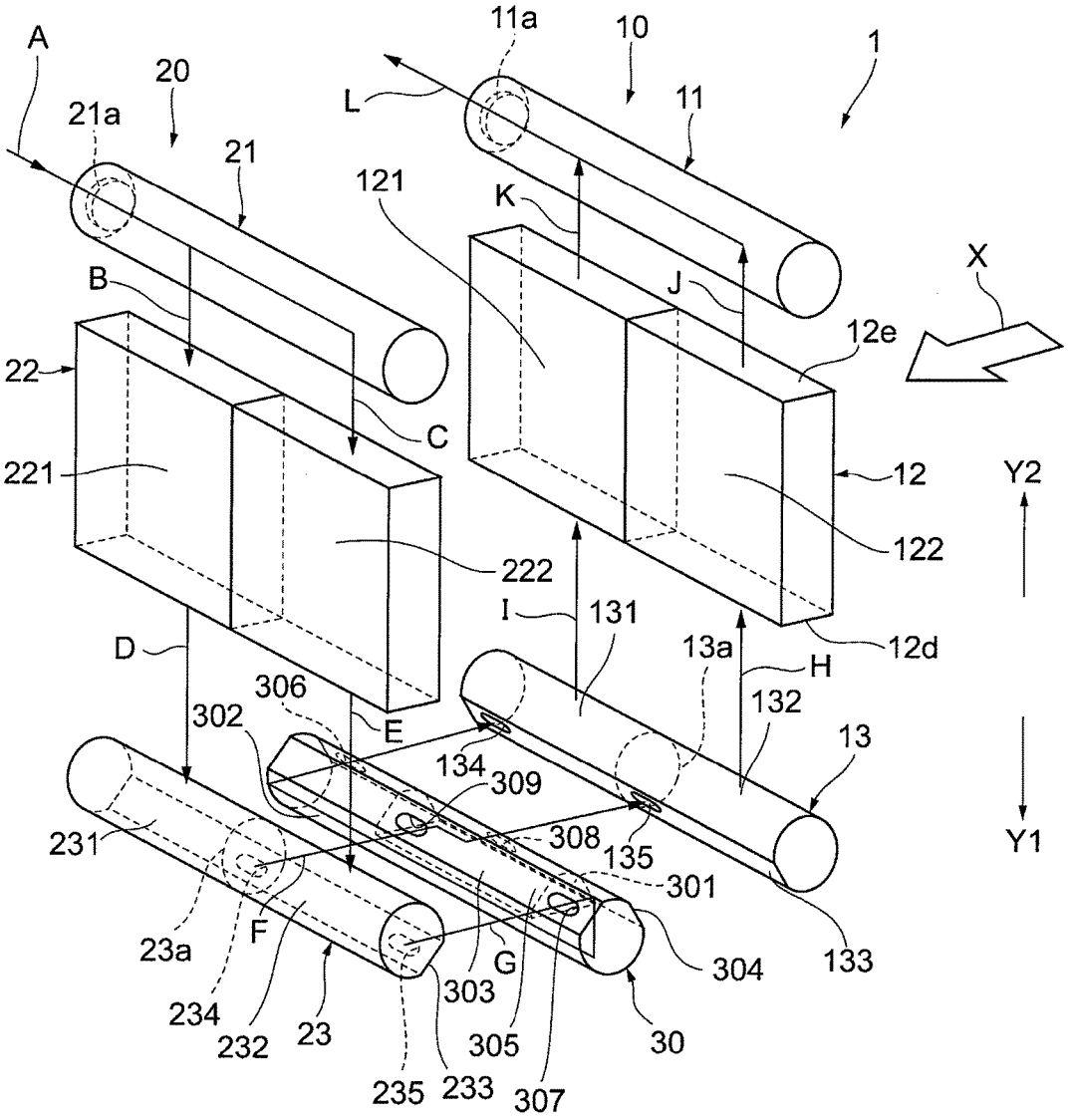
FIG. 6 is a schematic perspective view illustrating a flow of refrigerant in the refrigerant evaporator of the first embodiment.

The refrigerant decompressed by the non-illustrated expansion valve is introduced into the leeward side distribution tank 21 from the refrigerant inlet 21*a*, as shown in an arrow A in FIG. 6. The refrigerant is distributed in the leeward side distribution tank 21, as shown by arrows B and C, to flow into the first leeward side core part 221 and the second leeward side core part 222 of the leeward side distribution tank 21.

The refrigerant which flowed into the first leeward side core part 221 and the second leeward side core part 222 flows through inside of each tube 22*a* downward in the vertical direction Y1. At this time, the refrigerant which flows through the inside of the tube 22*a* performs heat exchange with air flowing outside of the tube 22*a* in the air flowing direction X. Thereby, a part of the refrigerant is evaporated to absorb heat from air, such that the air is cooled.

The refrigerant which flows through the tubes 22*a* of the first leeward side core part 221 is brought together in the first collection part 231 of the leeward side collection tank 23, as shown in an arrow D. The refrigerant brought together in the first collection part 231 flows into the second distribution part 132 of the windward side distribution tank 13 through the second refrigerant passage 303 of the switch tank 30, as shown in an arrow F. The refrigerant which flowed into the second distribution part 132 flows into the second windward side core part 122, as shown in an arrow H.

The refrigerant which flows through the tubes 22*a* of the second leeward side core part 222 is brought together in the second collection part 232 of the leeward side collection tank 23, as shown in an arrow E. The refrigerant brought together in the second collection part 232 flows into the first distribution part 131 of the windward side distribution tank 13 through the first refrigerant passage 302 of the switch tank 30, as shown in an arrow G. The refrigerant which flowed into the first distribution part 131 flows into the first windward side core part 121, as shown in an arrow I.

The refrigerant which flowed into the first windward side core part 121 and the second windward side core part 122 flows through the inside of the respective tube 22*a* upward in the vertical direction Y2. At this time, the refrigerant which flows through the inside of the tube 22*a* performs heat exchange with air which flows outside of the tube 22*a* in the air flowing direction X. Thereby, a part of the refrigerant is evaporated to absorb heat from air, such that the air is cooled.

The refrigerant which flows through the first windward side core part 121 and the second windward side core part 122 is brought together in the windward side collection tank 11, as shown in arrows K and J. The refrigerant brought together in the windward side collection tank 11 is supplied to the intake side of the non-illustrated compressor from the refrigerant outlet 11*a* of the windward side collection tank 11, as shown in an arrow L.

Next, operation and advantage of the joining section of the windward side distribution tank 13, the leeward side collection tank 23, and the switch tank 30 are explained.

When the joint portion 133 of the windward side distribution tank 13 and the joint portion 304 of the switch tank 30 are brazed to each other, a contact portion between the internal surface of the through hole 134, 135 of the windward side distribution tank 13 and the external surface of the projection part 310, 311 of the switch tank 30 works as a starting point of the brazing. Moreover, a contact portion between the internal surface of the recess part 136 of the windward side distribution tank 13 and the external surface of the projection part 312 of the switch tank 30 also works as a starting point of the brazing. Similarly, a contact portion between the internal surface of the through hole 234, 235 of the leeward side collection tank 23 and the external surface of the projection part 313, 314 of the switch tank 30, and a contact portion between the internal surface of the recess part 236 of the leeward side collection tank 23 and the external surface of the projection part 315 of the switch tank 30 work as a starting point of the brazing. Thereby, sink marks due to the brazing can be prevented because a surface brazing between the windward side distribution tank 13 and the switch tank 30 and a surface brazing between the leeward side collection tank 23 and the switch tanks 30 can be avoided. As a result, a gap where condensed water stays is hardly formed at a joining section between the windward side distribution tank 13 and the switch tank 30 and a joining section between the leeward side collection tank 23 and the switch tank 30. Thus, a freezing crack can be restricted from being generated.

Second Embodiment

Next, a refrigerant evaporator of a second embodiment is described. Hereafter, differences from the first embodiment are described.

Figure 7:
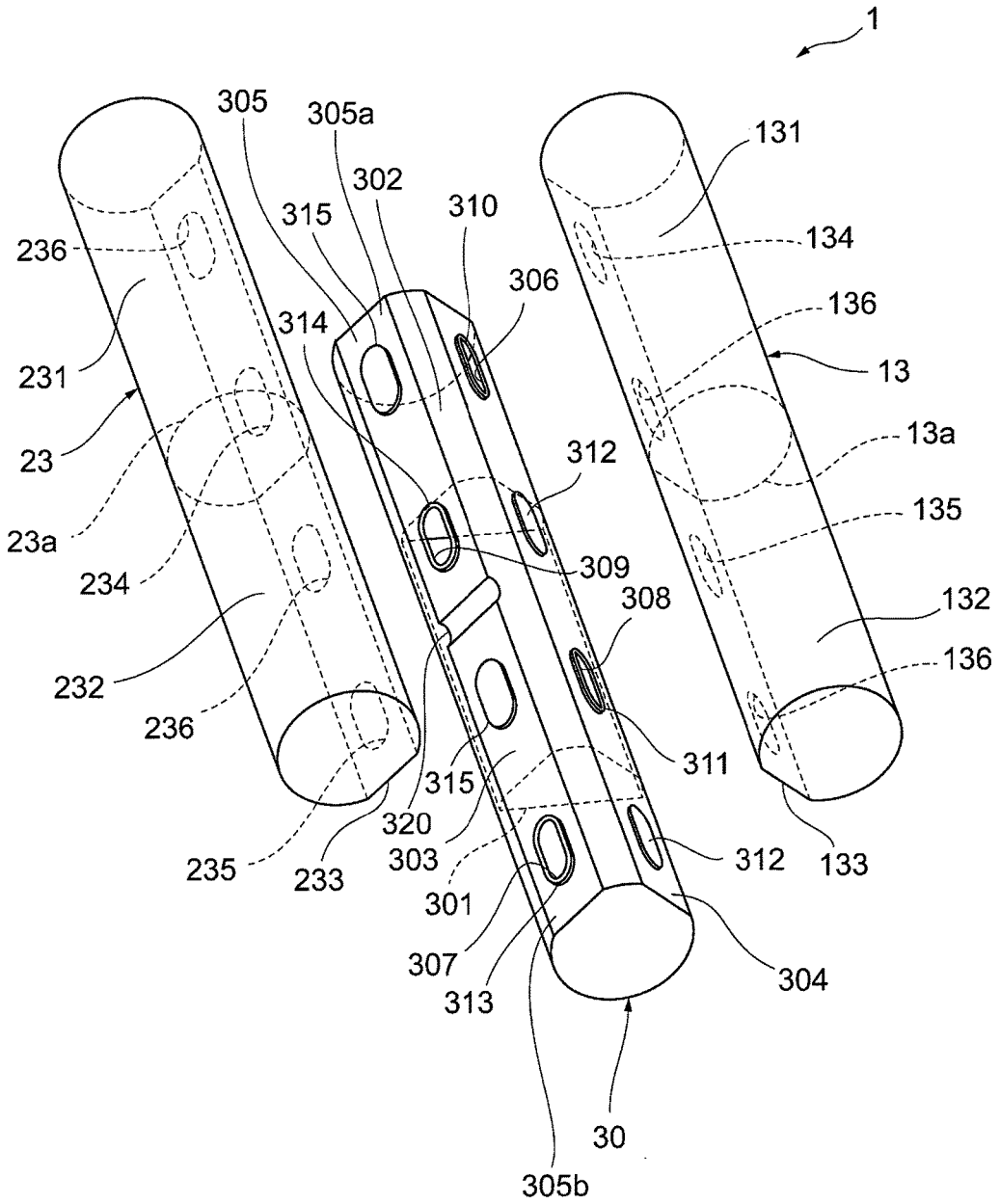
FIG. 7 is an exploded perspective view illustrating a windward distribution tank, a leeward collection tank, and a switch tank of a refrigerant evaporator according to a second embodiment.
Figure 8:
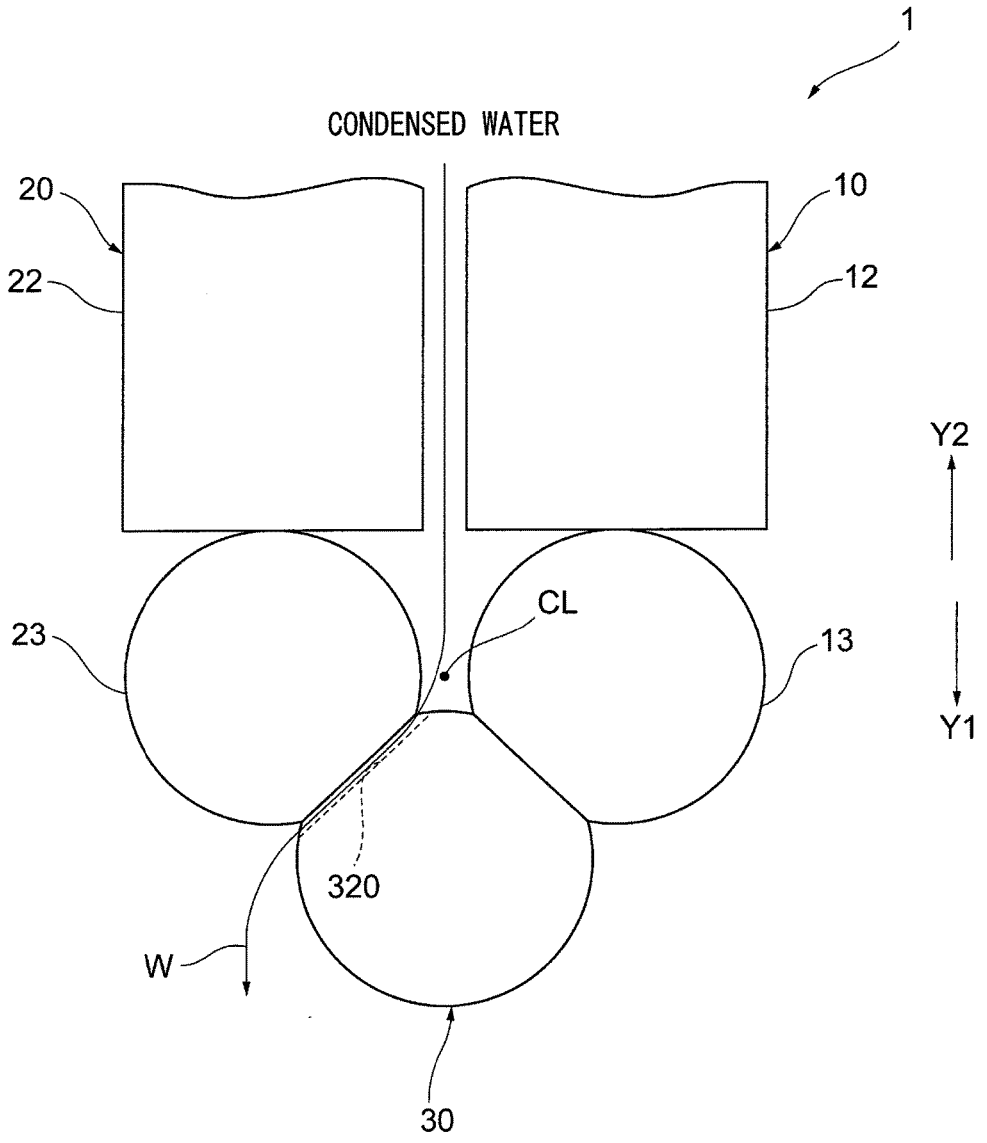
FIG. 8 is a side view illustrating a structure of a drain groove of a refrigerant evaporator of the second embodiment.

As shown in FIG. 7, a drain groove 320 is formed on the joint portion 305 of the switch tank 30 in the refrigerant evaporator 1 of this embodiment. Specifically, the drain groove 320 is formed between the projection part 314 and the projection part 315, around the central part of the joint portion 305 in the longitudinal direction. As shown in FIG. 8, an end part of the drain groove 320 is communicated to a clearance CL formed between the windward side distribution tank 13, the leeward side collection tank 23, and the switch tank 30. The other end of the drain groove 320 is communicated to a space below the leeward side collection tank 23 in the vertical direction Y1.

Next, operation and advantage of the refrigerant evaporator 1 of this embodiment are explained.

When heat is exchanged between refrigerant and air in the windward side heat exchange part 12 and the leeward side heat exchange part 22, water is condensed on the external surface of the windward side heat exchange part 12 and the leeward side heat exchange part 22. The condensed water flows downward in the vertical direction Y1. In case where the clearance CL is formed among the windward side distribution tank 13, the leeward side collection tank 23, and the switch tank 30, the condensed water stores in the clearance CL. If the stored water is frozen in the clearance CL, each of the tanks 13, 23, and 30 may be damaged by expansion in volume of water, as what is called a freezing crack.

At this point, according to the refrigerant evaporator 1 of this embodiment, as shown in an arrow W of FIG. 8, the condensed water stored in the clearance CL is discharged outside through the drain groove 320. Therefore, the freezing crack resulting from the freeze of water can be restricted since the condensed water hardly stays in the clearance CL.

When the drain groove 320 is formed in the joint portion 305 of the switch tank 30, as shown in FIG. 7, the joint portion 305 of the switch tank 30 is divided into two areas 305*a* and 305*b* by the drain groove 320. In the case of such a structure, it is necessary to perform brazing to each of the areas 305*a* and 305*b*.

At this point, in the refrigerant evaporator 1 of this embodiment, a brazing place between the through hole 234 of the leeward side collection tank 23 and the projection part 314 of the switch tank 30 and a brazing place between the recess part 236 of the leeward side collection tank 23 and the projection part 315 of the switch tank 30 are located in the area 305*a* which is one of the divided areas. Moreover, a brazing place between the through hole 235 of the leeward side collection tank 23 and the projection part 313 of the switch tank 30 and a brazing place between the recess part 236 of the leeward side collection tank 23 and the projection part 315 of the switch tank 30 are located in the area 306*b* which is the other of the divided areas. That is, the brazing places are separated by the drain groove 320. Accordingly, the brazing stability between the leeward side collection tank 23 and the switch tank 30 can be improved, since the brazing can be performed in each of the areas 305*a* and 305*b* divided from each other.

First Modification

Next, a first modification of the refrigerant evaporator 1 of the second embodiment is explained.

Figure 9:
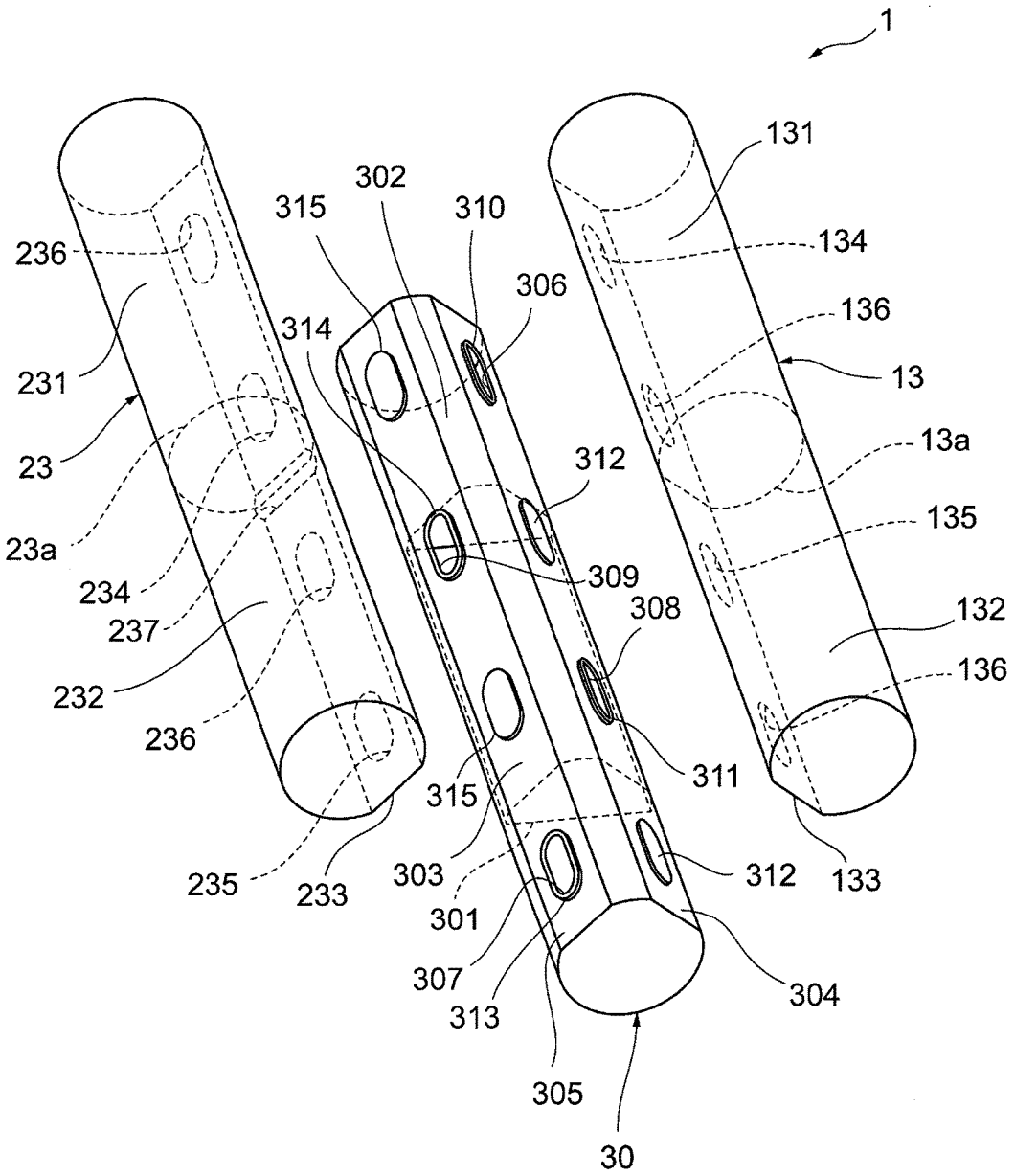
FIG. 9 is an exploded perspective view illustrating a windward distribution tank, a leeward collection tank, and a switch tank of a refrigerant evaporator according to a first modification of the second embodiment.

As shown in FIG. 9, a drain groove 237 is formed on the joint portion 233 of the leeward side collection tank 23 in the refrigerant evaporator 1 of this modification. Specifically, the drain groove 237 is formed between the through hole 234 and the recess part 236, around the central part of the joint portion 233 in the longitudinal direction. A clearance CL formed among the tanks 13, 23, and 30 is communicated to a space below the leeward side collection tank 23 in the vertical direction Y1 by the drain groove 237. In this case, similar operation and advantage can be acquired as the structure illustrated in FIG. 7 and FIG. 8.

Second Modification

Next, a second modification of the refrigerant evaporator 1 of the second embodiment is explained.

Figure 10:
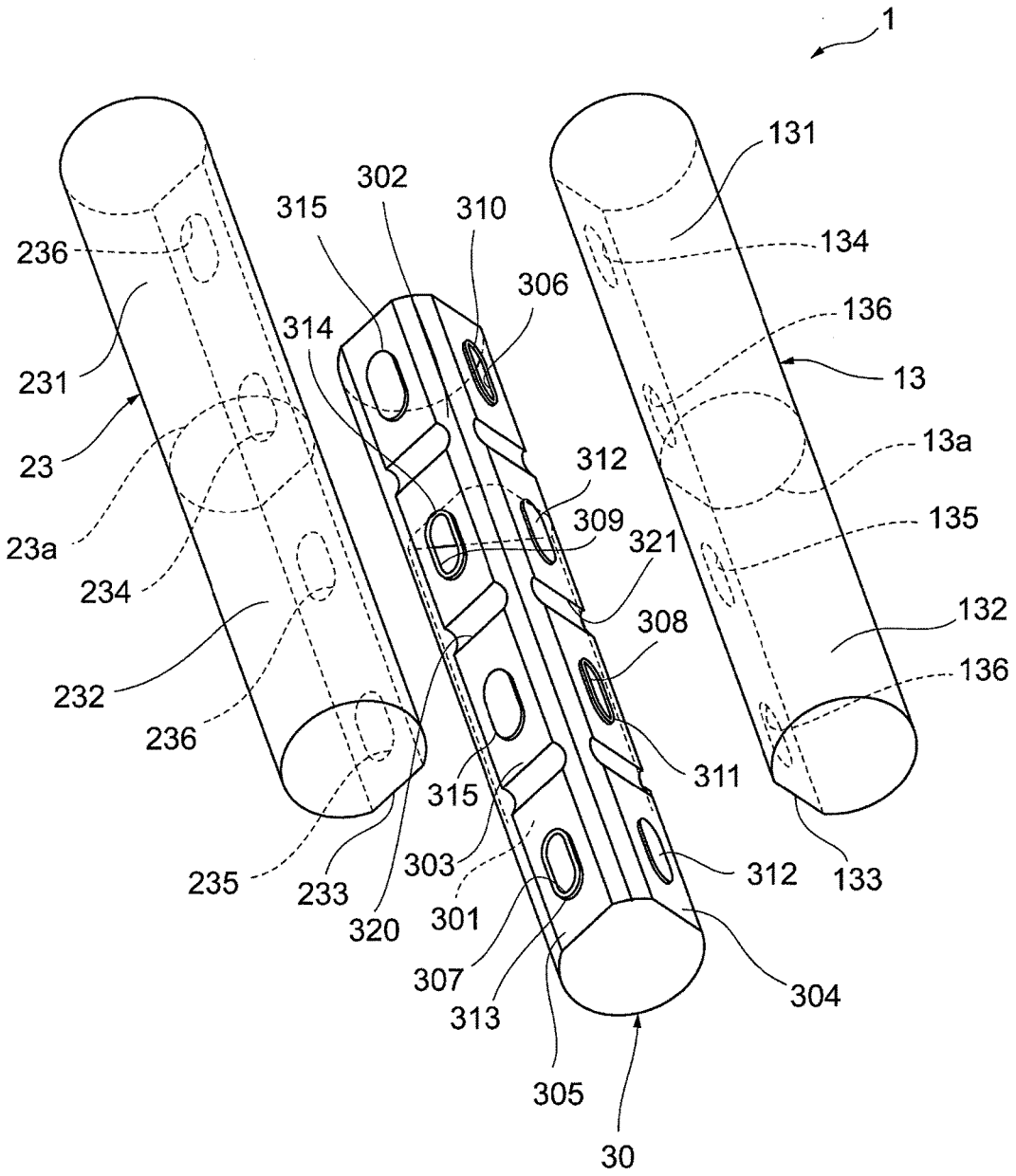
FIG. 10 is an exploded perspective view illustrating a windward distribution tank, a leeward collection tank, and a switch tank of a refrigerant evaporator according to a second modification of the second embodiment.

As shown in FIG. 10, plural drain grooves 320 are formed on the slope surface of the joint portion 305 of the switch tank 30 in the refrigerant evaporator 1 of this modification. Specifically, the drain groove 320 is formed between the projection part 313 and one of the projection parts 315, between the one of the projection parts 315 and the projection part 314, and between the projection part 314 and the other projection part 315. The clearance CL formed among the tanks 13, 23, and 30 is communicated to a space below the leeward side collection tank 23 in the vertical direction Y1 by the drain groove 320.

Plural drain grooves 321 are formed also on the slope surface of the joint portion 304 of the switch tank 30. Specifically, the drain groove 321 is formed between the projection part 310 and one of the projection parts 312, between the one of the projection parts 312 and the projection part 311, and between the projection part 311 and the other projection part 312. The clearance CL formed among the tanks 13, 23, and 30 is communicated to a space below the windward side distribution tank 13 in the vertical direction Y1 by the drain groove 321.

The drainage property of condensed water can be raised when the multiple drain grooves 320, 321 are formed in the switch tank 30 in this way, compared with a case where the refrigerant evaporator 1 has only one drain groove 321 illustrated in FIG. 7 and FIG. 8. Thus, a freezing crack can be more suitably restricted in each of the tanks 13, 23, and 30.

Meanwhile, a brazing place between the through hole 234, 235 of the leeward side collection tank 23 and the projection part 313, 314 of the switch tank 30, and a brazing place between the recess part 236 of the leeward side collection tank 23 and the projection part 315 of the switch tank 30 are separated from each other by the drain groove 320. Moreover, a brazing place between the through hole 134, 135 of the windward side distribution tank 13 and the projection part 310, 311 of the switch tank 30, and a brazing place between the recess part 136 of the windward side distribution tank 13 and the projection part 312 of the switch tank 30 are separated from each other by the drain groove 321. Since brazing can be performed in each of the areas divided by the drain groove 320, 321 in the joint portion 304, 305 of the switch tank 30, the brazing stability between the windward side distribution tank 13 and the switch tank 30, and the brazing stability between the leeward side collection tank 23 and the switch tank 30 can be improved.

Third Modification

Next, a third modification of the refrigerant evaporator 1 of the second embodiment is explained.

Figure 11:
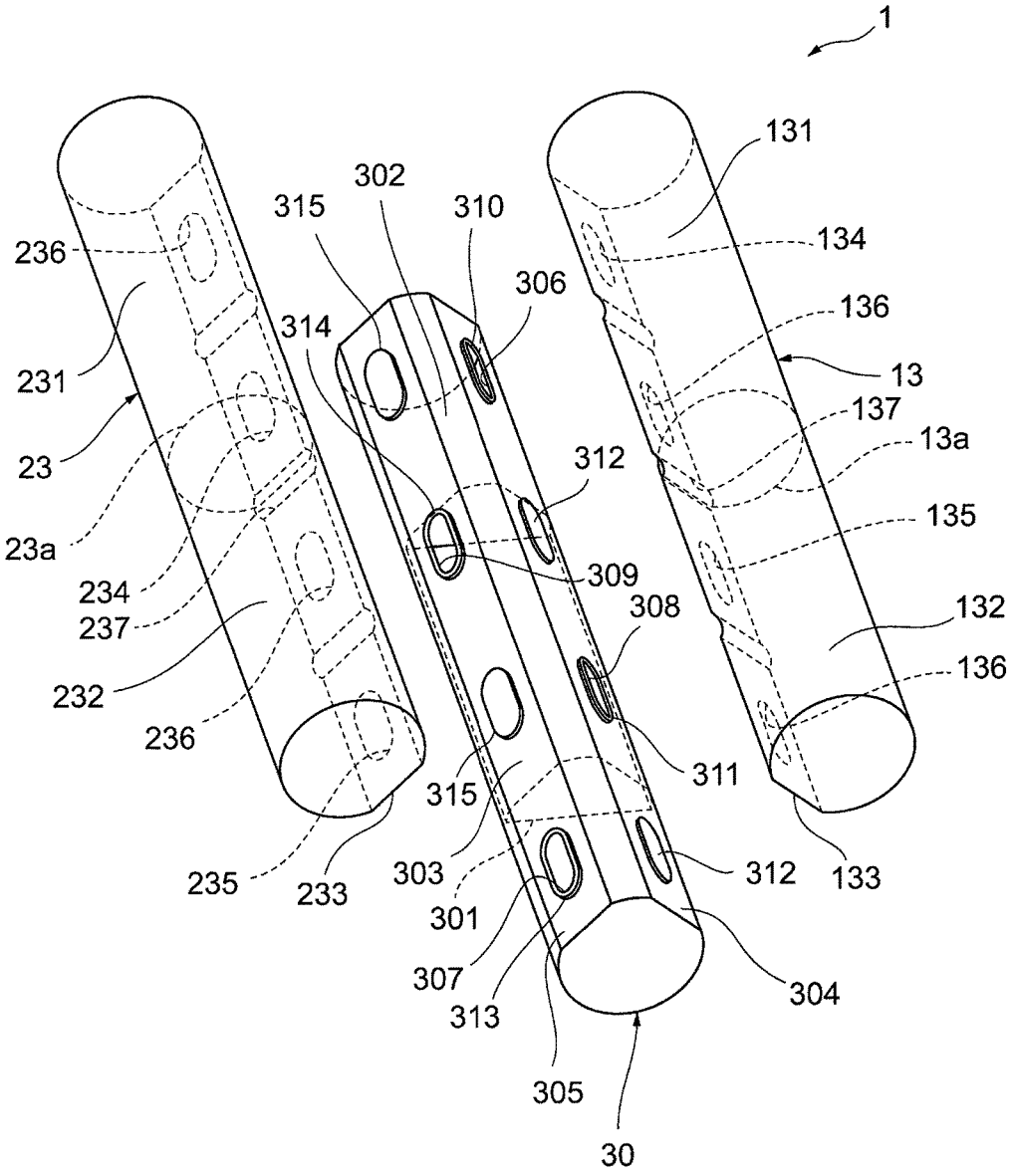
FIG. 11 is an exploded perspective view illustrating a windward distribution tank, a leeward collection tank, and a switch tank of a refrigerant evaporator according to a third modification of the second embodiment.

As shown in FIG. 11, plural drain grooves 137 are formed in the joint portion 133 of the windward side distribution tank 13 in the refrigerant evaporator 1 of this modification. Specifically, the drain groove 137 is formed between the through hole 134 and one of the recess parts 136, between the one of the recess parts 136 and the through hole 135, and between the through hole 135 and the other recess part. The clearance CL formed among the tanks 13, 23, and 30 is communicated to a space below the windward side distribution tank 13 in the vertical direction Y1 by the drain groove 137.

Plural drain grooves 237 are formed also in the joint portion 233 of the leeward side collection tank 23. Specifically, the drain groove 237 is formed between the through hole 234 and one of the two recess parts 236, between the one of the two recess parts 236 and the through hole 235, and between the through hole 235 and the other recess part 236. The clearance CL formed among the tanks 13, 23, and 30 is communicated to a space below the leeward side collection tank 23 in the vertical direction Y1 by the drain groove 237.

In this case, similar operation and advantage can be acquired as the structure illustrated in FIG. 10.

Third Embodiment

Next, a refrigerant evaporator 1 according to a third embodiment is described. Hereafter, differences from the first embodiment are described.

Figure 12:
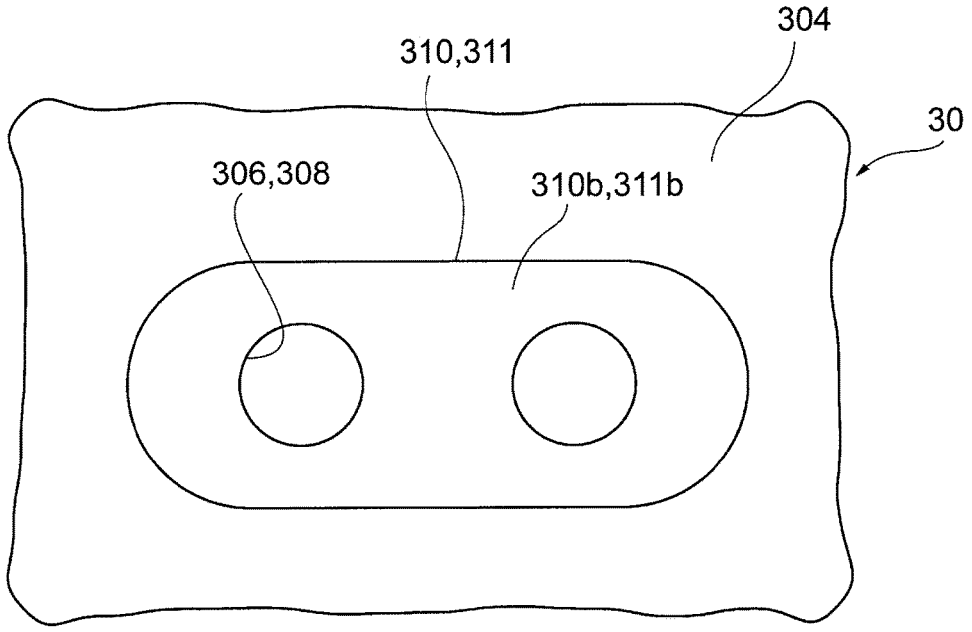
FIG. 12 is an enlarged view illustrating a projection part of a switch tank of a refrigerant evaporator according to a third embodiment.
Figure 13:
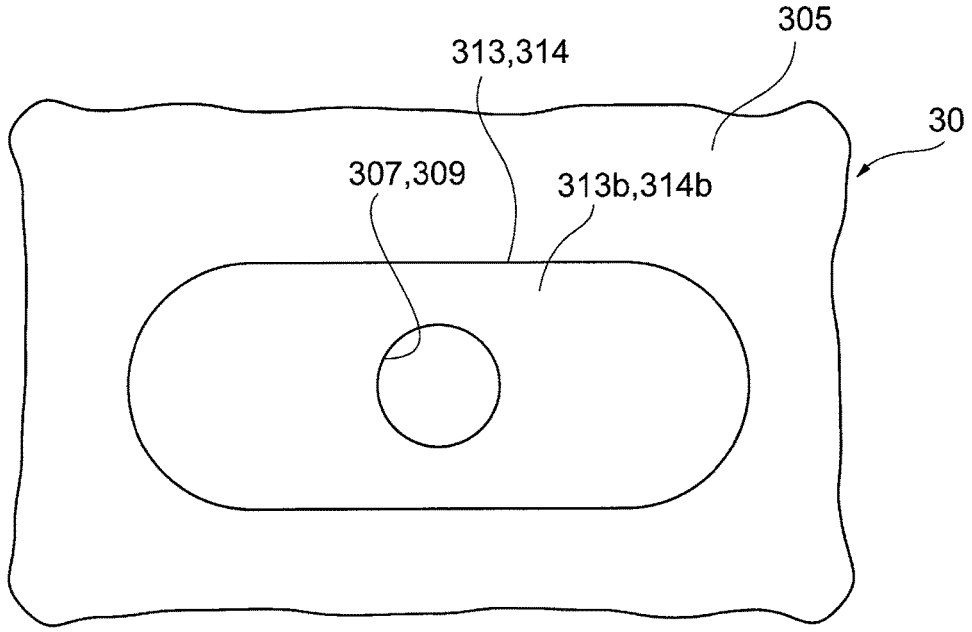
FIG. 13 is an enlarged view illustrating a projection part of the switch tank of the refrigerant evaporator of the third embodiment.

As shown in FIG. 12, a tip end surface 310*b*, 311*b* of the projection part 310, 311 defined in the joint portion 304 of the switch tank 30 has two through holes 306, 308 which define the refrigerant passage, respectively. Moreover, as shown in FIG. 13, a tip end surface 313*b*, 314*b* of the projection part 313, 314 defined in the joint portion 305 of the switch tank 30 has one through hole 307, 309 which defines the refrigerant passage. The through holes 306-309 have the same form.

According to this embodiment, the total cross-section area of the through holes 306, 308 formed in the projection part 310, 311 is different from the total cross-section area of the through holes 307, 309 formed in the projection part 313, 314. The total cross-section area represents the sum of the cross-section areas of the through holes formed in one projection part. The flow rate of the refrigerant which flows from the leeward side collection tank 23 into the switch tank 30 is made different from the flow rate of the refrigerant which flows from the switch tank 30 into the windward side distribution tank 13. Therefore, the distribution amount of the refrigerant can be controlled in each of the windward side core part 121, 122 and the leeward side core part 221, 222. As a result, each heat exchange performance of the windward side core part 121,122 and the leeward side core part 221, 222 can be controlled. Moreover, the distribution amount of the refrigerant can be changed in each of the windward side core part 121, 122 and the leeward side core part 221, 222 easily by only changing the number of the through holes 306-309.

Moreover, the switch tank 30 of this embodiment can be manufactured, for example by the following methods. First, the switch tank 30 is prepared, which has the projection part 310, 311, 313, 314 in which the through holes 306-309 are not formed, and the projection part 312, 315. Then, the switch tank 30 can be manufactured by forming the needed number of the through holes in the projection part 310, 311, 313, 314 using a common die corresponding to the form of the through hole 306-309. According to such a production method, the productivity can be raised when the distribution amount of the refrigerant is controlled between the windward side core part 121, 122 and the leeward side core part 221, 222, since what is necessary is just to change the number of the through holes 306-309 formed in the projection part 310, 311, 313, 314. Moreover, the cost can also be reduced since it is not necessary to change the die for forming the through holes 306-309.

Other Embodiment

Each of the embodiments may be modified as the following.

In the refrigerant evaporator 1 of the second embodiment, the drain groove 320 formed in the joint portion 305 of the switch tank 30, and the drain groove 237 formed in the joint portion 233 of the leeward side collection tank 23 may be combined to define one or plural drain grooves. Similarly, the drain groove 321 formed in the joint portion 304 of the switch tank 30, and the drain groove 137 formed in the joint portion 133 of the windward side distribution tank 13 may be combined to define one or plural drain grooves.

Figure 14:
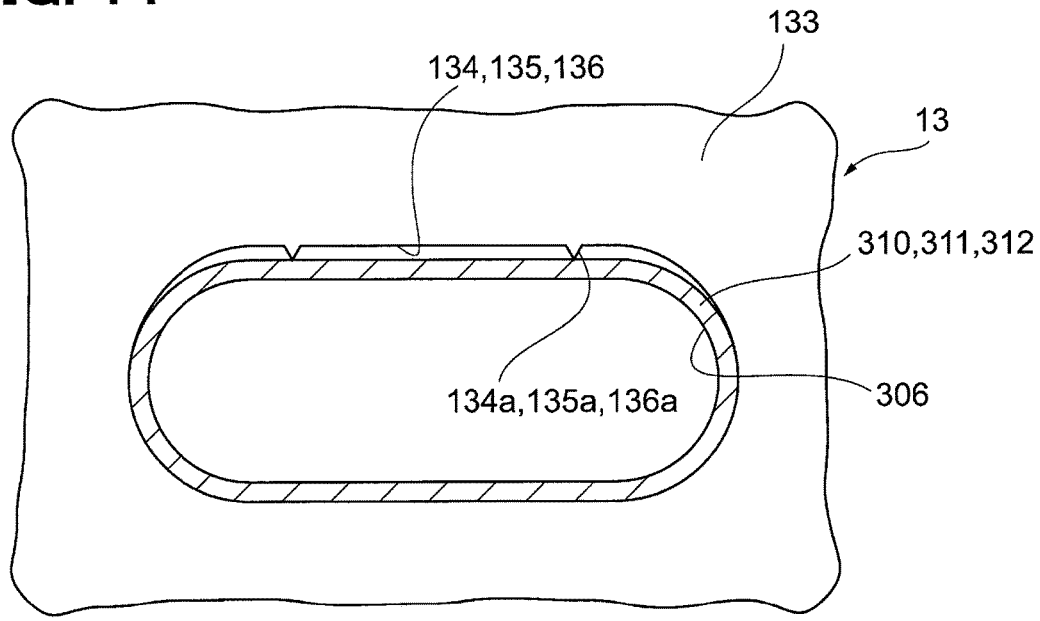
FIG. 14 is an enlarged view illustrating a through hole of a windward distribution tank and a projection part of a switch tank of a refrigerant evaporator according to the other embodiment.

As shown in FIG. 14, a protruding part 134*a* in contact with the external surface of the projection part 310 of the switch tank 30 may be defined on the internal surface of the through hole 134 of the windward side distribution tank 13. Moreover, protruding parts 135*a* and 136*a* in contact with the external surface of the projection part 311, 312 of the switch tank 30 may be defined on the internal surface of the through hole 135 and the recess part 136 of the windward side distribution tank 13, respectively. Accordingly, when brazing is performed between the through hole 134,135 and the recess part 136 of the windward side distribution tank 13, and the projection part 310-312 of the switch tank 30, the protruding parts 134*a*, 135*a*, and 136*a* work as a starting point of the brazing. Thereby, since a surface brazing between them can be avoided, sink marks are hardly generated. Therefore, the projection parts 310-312 of the switch tank 30 can more certainly be fixed to the through hole 134, 135 and the recess part 136 of the windward side distribution tank 13. Similarly, a protruding part may be formed on the internal surface of the through hole 234, 235 and the recess part 236 of the leeward side collection tank 23.

Figure 15:
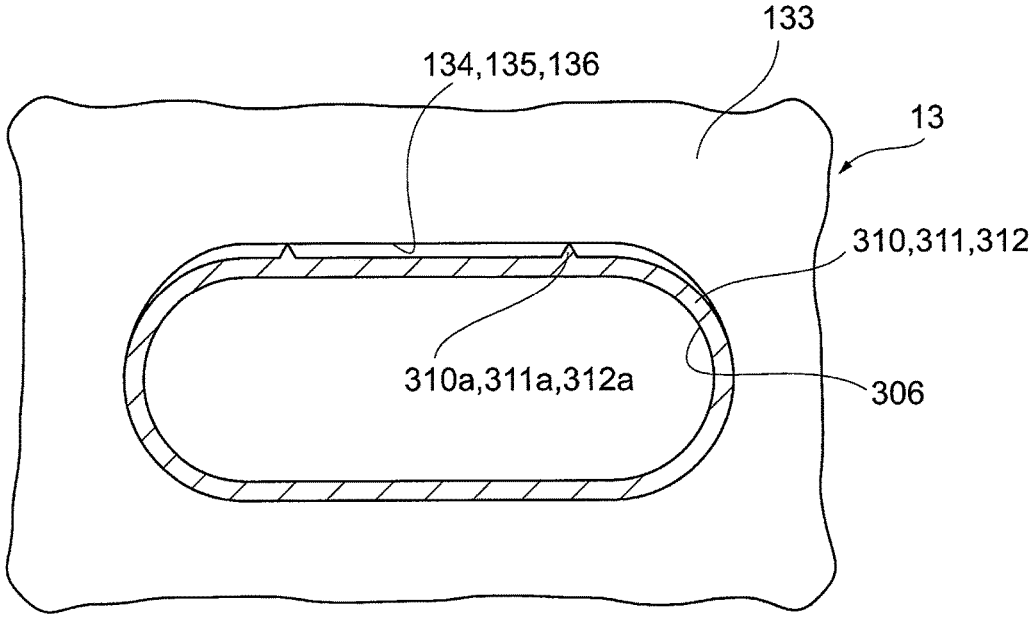
FIG. 15 is an enlarged view illustrating a through hole of a windward distribution tank and a projection part of a switch tank of a refrigerant evaporator according to the other embodiment.

As shown in FIG. 15, a protruding part 310*a* in contact with the internal surface of the through hole 134 of the windward side distribution tank 13 may be formed in the external surface of the projection part 310 of the switch tank 30. Moreover, protruding parts 311*a* and 312*a* in contact with the internal surface of the through hole 135 and the recess part 136 of the windward side distribution tank 13 may be formed on the external surface of the projection part 311, 312 of the switch tank 30 respectively. The similar operation and advantage can be acquired as the structure illustrated in FIG. 14. Similarly, a protruding part may be formed in the external surface of the projection part 313-315 of the switch tank 30.

The shape of the through hole 134, 135 and the recess part 136 of the windward side distribution tank 13 can be changed suitably. Moreover, the shape of the through hole 234, 235 and the recess part 236 of the leeward side collection tank 23 can also be changed suitably. Furthermore, the shape of the projection part 310-315 of the switch tank 30 can also be changed suitably.

Figure 16:
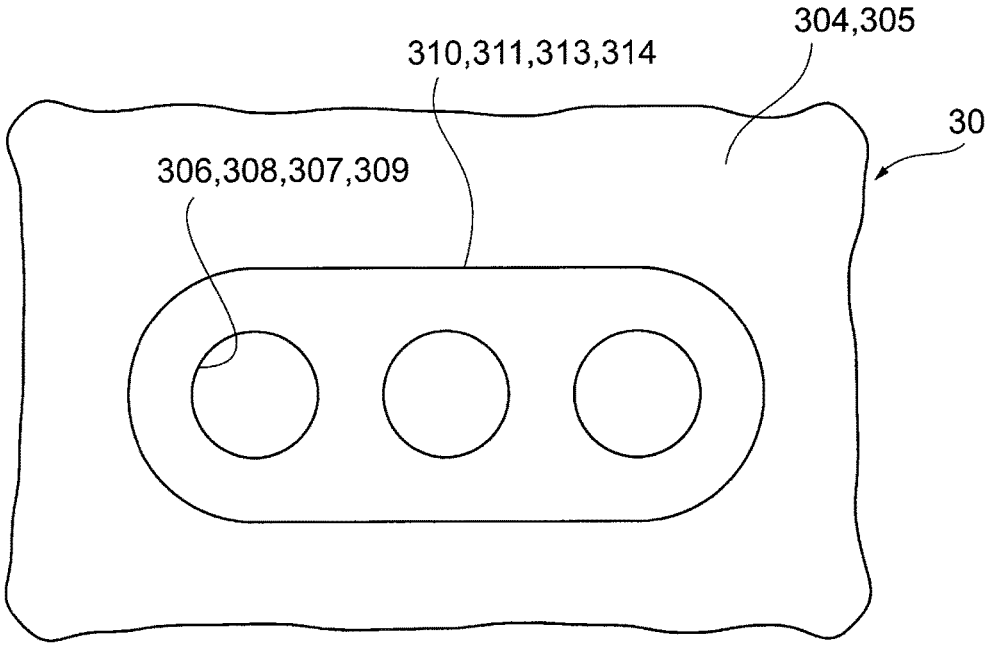
FIG. 16 is an enlarged view illustrating a projection part of a switch tank of a refrigerant evaporator according to the other embodiment.

As shown in FIG. 16, in the refrigerant evaporator 1 of the first embodiment and the second embodiment, plural through holes 306 may be formed in the projection part 310 of the switch tank 30. Similarly, plural through holes 308, 307, 309 may be formed in the projection part 311, 313, 314 of the switch tank 30.

In the refrigerant evaporator 1 of the third embodiment, the number of the through holes 306-309 formed in the projection part 310, 311, 313, 314 may be changed suitably. In short, the projection part 310, 311, 313, 314 has singular or plural through holes which define the refrigerant passage. Moreover, the number of the through holes formed in at least one of the projection parts may be set different from the number of the through holes formed in the other projection parts, if needed. Furthermore, the total cross-section area of the through holes formed in at least one of the projection parts may be set different from the total cross-section area of the through holes formed in the other projection parts.

The cross-section area of the through hole 134 of the windward side distribution tank 13 may differ from the cross-section area of the through hole 306 formed in the projection part 310 of the switch tank 30. In this case, the flow rate (the amount of distribution) of the refrigerant which flows from the switch tank 30 to the first distribution part 131 of the windward side distribution tank 13 can be controlled. The same may be applied to the through hole 135 of the windward side distribution tank 13, the through hole 234, 235 of the leeward side set tank 23, and the through hole 307, 308, 309 of the switch tank 30.

In each of the embodiments, the projection parts 310-312 are formed in the joint portion 304 of the switch tank 30, and the through hole 134, 135 and the recess part 136 are formed as insertion part in the joint portion 133 of the windward side distribution tank 13. Alternatively, a projection part may be formed in the joint portion 133 of the windward side distribution tank 13, and an insertion part to which the projection part is inserted may be formed in the joint portion 304 of the switch tank 30. Similarly, a projection part may be formed in the joint portion 233 of the leeward side set tank 23, and an insertion part in which the projection part is inserted may be formed in the joint portion 305 of the switch tank 30.

The fluid to be cooled in the refrigerant evaporator 1 is not limited to air, and appropriate fluid can be used.

It should be appreciated that the present disclosure is not limited to the embodiments described above and can be modified appropriately within the scope of the present disclosure. The scope of the present disclosure is not limited to the range exemplified with the structure of the embodiment. The range of the present disclosure is shown by the appended claims, and also includes all the changes in the equivalence. For example, each element, its arrangement, material, condition, shape, size and the like in each embodiment is not limited to the example, and is suitably modified. It is possible to combine the elements of the embodiments, provided it is technically possible.

What is claimed is:

1. A refrigerant evaporator in which heat is exchanged between a fluid to be cooled and a refrigerant, the refrigerant evaporator comprising:

a first heat exchange part in which the refrigerant flows to exchange heat between the fluid to be cooled and the refrigerant;

a second heat exchange part in which the refrigerant flows to exchange heat between the fluid to be cooled and the refrigerant, the second heat exchange part being arranged to oppose the first heat exchange part;

a first tank arranged below the first heat exchange part to distribute the refrigerant to the first heat exchange part;

a second tank arranged below the second heat exchange part to collect the refrigerant flowing through the second heat exchange part; and a third tank joined to the first tank and the second tank by brazing and to introduce the refrigerant collected by the second tank to the first tank, wherein one of joint portions between the first tank and the third tank or one of joint portions between the second tank and the third tank has a projection part, the other of the joint portions between the first tank and the third tank or the other of the joint portions between the second tank and the third tank has an insertion part in which the projection part is inserted, an external surface of the projection part and an internal surface of the insertion part are brazed to each other at a brazing place, the brazing place is one of a plurality of brazing places, at least one drain groove is formed between the first tank and the third tank or between the second tank and the third tank, and the drain groove separates the plurality of brazing places.

2. The refrigerant evaporator according to claim 1, wherein a protruding part in contact with an external surface of the projection part is formed on an internal surface of the insertion part.

3. The refrigerant evaporator according to claim 1, wherein a protruding part in contact with an internal surface of the insertion part is formed on an external surface of the projection part.

4. The refrigerant evaporator according to claim 1, wherein the insertion part and the projection part are defined at a portion other than a portion where a passage for the refrigerant is defined.

5. A refrigerant evaporator in which heat is exchanged between a fluid to be cooled and a refrigerant, the refrigerant evaporator comprising:

a first heat exchange part in which the refrigerant flows to exchange heat between the fluid to be cooled and the refrigerant;

a second heat exchange part in which the refrigerant flows to exchange heat between the fluid to be cooled and the refrigerant, the second heat exchange part being arranged to oppose the first heat exchange part;

a first tank arranged below the first heat exchange part to distribute the refrigerant to the first heat exchange part;

a second tank arranged below the second heat exchange part to collect the refrigerant flowing through the second heat exchange part; and a third tank joined to the first tank and the second tank by brazing and to introduce the refrigerant collected by the second tank to the first tank, wherein one of joint portions between the first tank and the third tank or one of joint portions between the second tank and the third tank has a projection part, the other of the joint portions between the first tank and the third tank or the other of the joint portions between the second tank and the third tank has an insertion part in which the projection part is inserted, a passage for the refrigerant is defined in each of the insertion part and the projection part, and the projection part has one through hole or a plurality of through holes which defines the passage for the refrigerant.

6. The refrigerant evaporator according to claim 5, wherein the projection part is one of a plurality of projection parts; and the number of the through holes formed in at least one of the plurality of projection parts is different from the number of the through holes formed in the other of the plurality of projection parts.

7. The refrigerant evaporator according to claim 5, wherein the projection part is one of a plurality of projection parts, and a total cross-section area of the through holes formed in at least one of the plurality of projection parts is different from a total cross-section area of the through holes formed in the other of the plurality of projection parts.

* * * * *